US006098856A

United States Patent [19]

Reilly

[11] Patent Number: 6,098,856

[45] Date of Patent: Aug. 8, 2000

[54] SHOULDER BABY CARRIER

[76] Inventor: Peter C. Reilly, 250 Gorge Rd., Suite 6J, Cliffside Park, N.J. 07010

[21] Appl. No.: 09/392,605

[22] Filed: Sep. 9, 1999

[51] Int. Cl.[7] ..... A61G 1/00

[52] U.S. Cl. ..... 224/160; 224/159; 224/181; D3/213

[58] Field of Search ..... 224/158, 159, 224/160, 161, 181; D3/213, 214

[56] References Cited

U.S. PATENT DOCUMENTS

| | | | |
|---|---|---|---|
| 268,932 | 12/1882 | Poirier | 224/181 |
| 3,610,489 | 10/1971 | Parsons | 224/161 X |
| 3,968,910 | 7/1976 | Dye et al. | 224/161 |
| 4,416,403 | 11/1983 | Johnson | 224/161 |
| 4,484,700 | 11/1984 | Bush | 224/161 |
| 5,868,292 | 2/1999 | Stephens et al. | 224/161 |

*Primary Examiner*—Gregory M. Vidovich
*Attorney, Agent, or Firm*—Charles E. Baxley, Esq

[57] ABSTRACT

A carrier for babies includes a horizontal head strap and an overhead strap which are placed on the user's head and a pair of underarm straps which are placed under the user's arms. The head strap is connected to a pair of baby shoulder straps, a baby seat strap and a baby waist strap. The baby seat strap and the baby shoulder straps are connected to a baby seat back which supports the baby's back while the baby is seated on the baby seat strap. The carrier provides the baby with an unobstructed view of the surrounding area.

10 Claims, 4 Drawing Sheets

SHOULDER BABY CARRIER

BACKGROUND OF THE INVENTION

1. Field of the Invention

The present invention relates generally to the field of baby carriers and more particularly to a shoulder baby carrier for carrying a baby on the shoulders of a user in a safe and convenient manner.

2. The Prior Art

The prior art related to baby carriers includes examples of well known baby carriers which are constructed using the structural principles of back pack frames or knapsacks. In the carriers according to the prior art, a metal frame assembly is mounted on the user's back with shoulder straps. A fabric sling-type seat is attached to the frame assembly and the baby is placed in the sling seat. The baby's head is generally at or somewhat below the level of the user's shoulders. While the conventional baby carrier has been found to be acceptable for young children, older children find that their view is obstructed by the neck and shoulders of the user and children often twist and squirm to turn sideways in order to be able to see their surroundings. This results in a measure of discomfort both for the child and for the user of the carrier.

Despite the various developments in the prior art related to baby carriers, there remains a need for a baby carrier which enables the baby to be carried on the shoulders of a viewer, thereby providing him or her with an unobstructed view.

OBJECTS AND SUMMARY OF THE INVENTION

It is therefore an object of the present invention to provide a shoulder baby carrier which facilitates carrying a baby on the shoulders of a user in a safe and convenient manner.

Another object of the present invention is to provide a shoulder baby carrier which provides effective support for the baby's back.

Yet another object of the present invention is to provide a shoulder baby carrier which includes a relatively small number of component parts which can be manufactured economically, resulting in a relatively low overall cost.

The foregoing and other objects and advantages of the present invention will appear more clearly hereinafter.

In accordance with the present invention there is provided a shoulder baby carrier which includes a horizontal head strap, an overhead strap and a pair of underarm straps which are placed on the user's head and under the user's arms, respectively. The head strap is connected to a pair of baby shoulder straps, a baby seat strap and a baby waist strap. The baby seat strap and the baby shoulder straps are connected to the baby seat back. The shoulder baby carrier enables a baby to be carried on the user's shoulders in a secure and comfortable manner while providing the baby with an unobstructed view of the surrounding area.

DESCRIPTION OF THE DRAWINGS

Other important objects and advantages of the present invention will be apparent from the following detailed description taken in connection with the accompanying drawings in which.

DETAILED DESCRIPTION OF THE INVENTION

Figure 1:
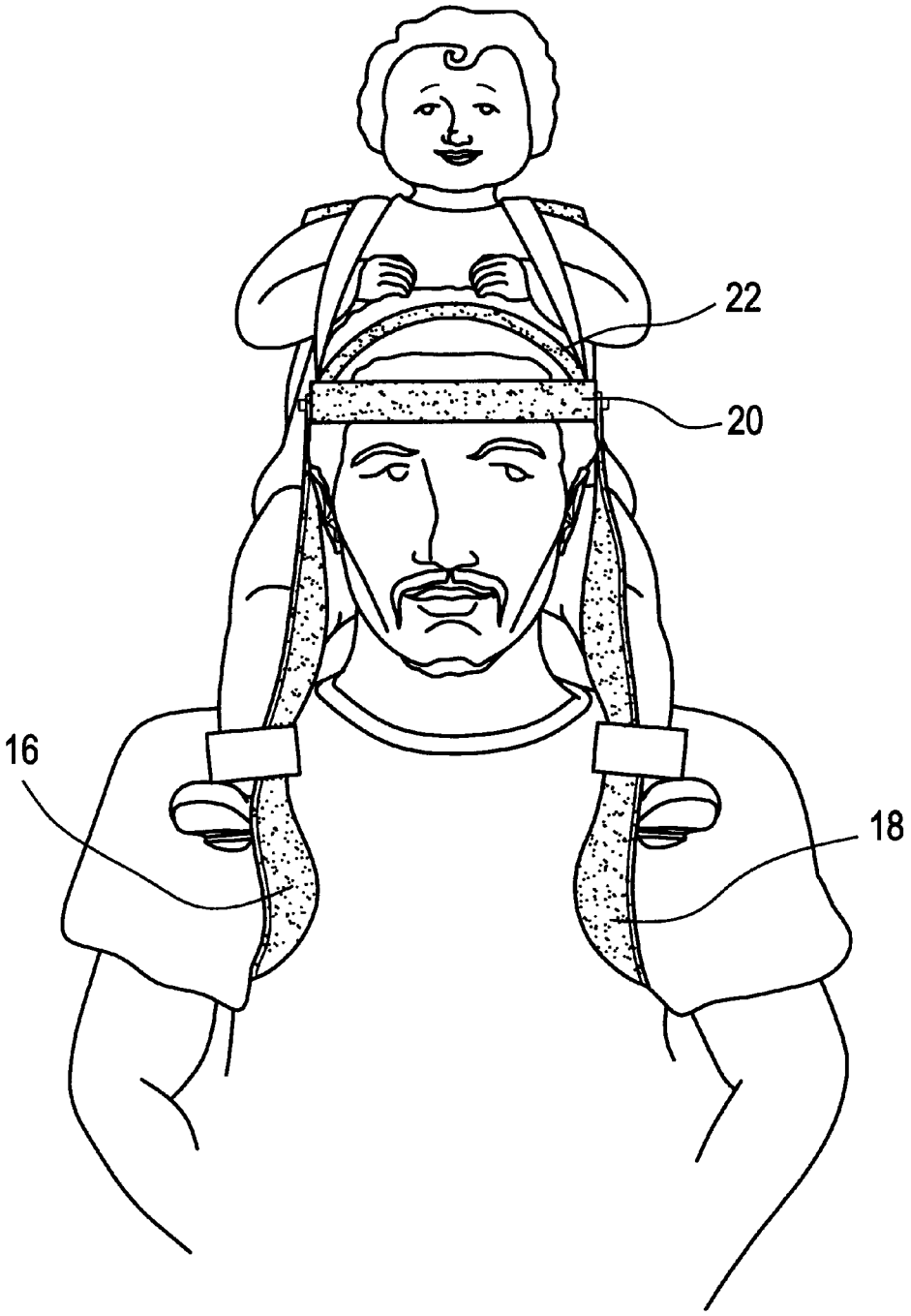
FIG. 1 is a front perspective view of a shoulder baby carrier, made in accordance with the present invention, with the shoulder baby carrier shown in use.
Figure 2:
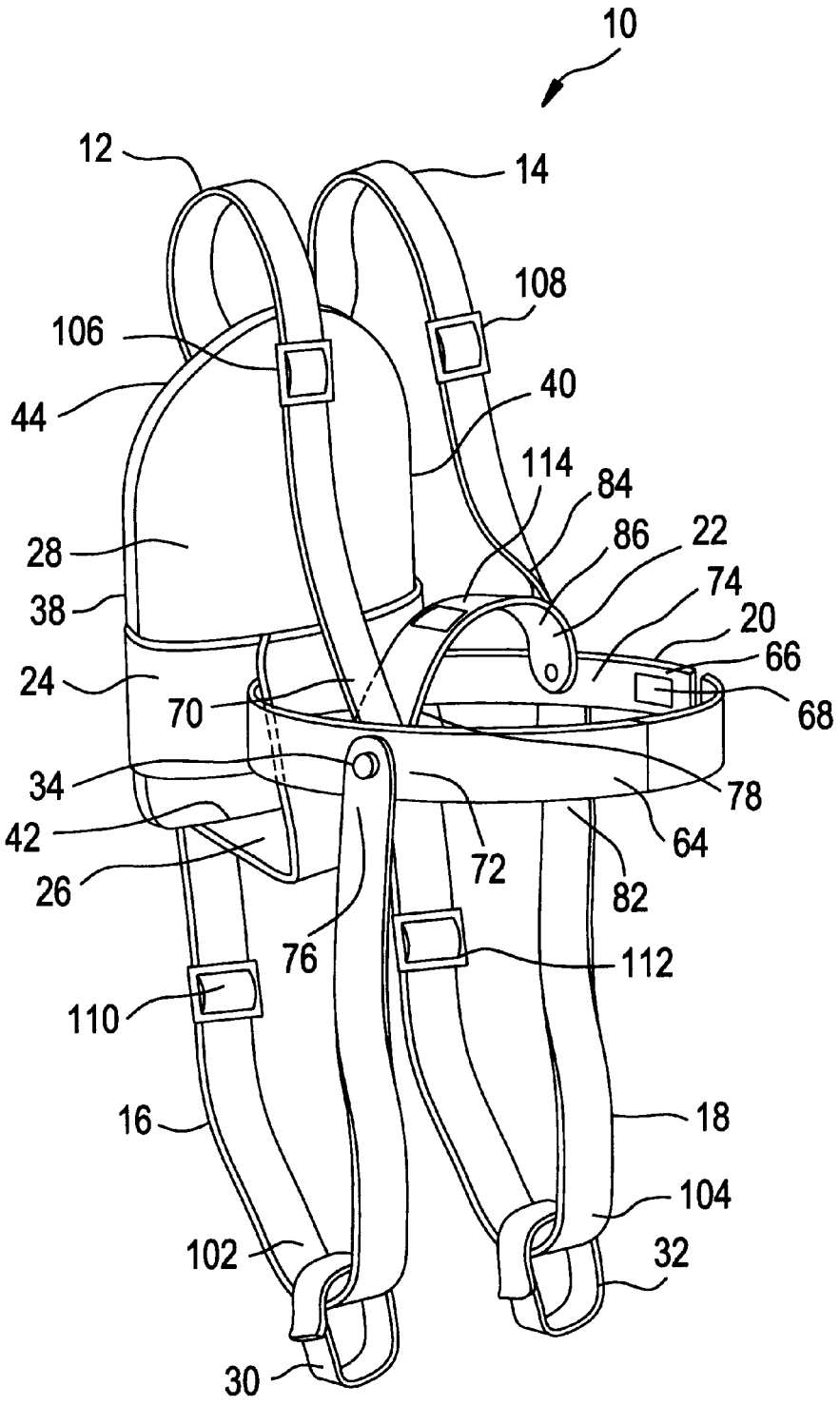
FIG. 2 is an overall perspective view of the shoulder baby carrier of FIG. 1.
Figure 3:
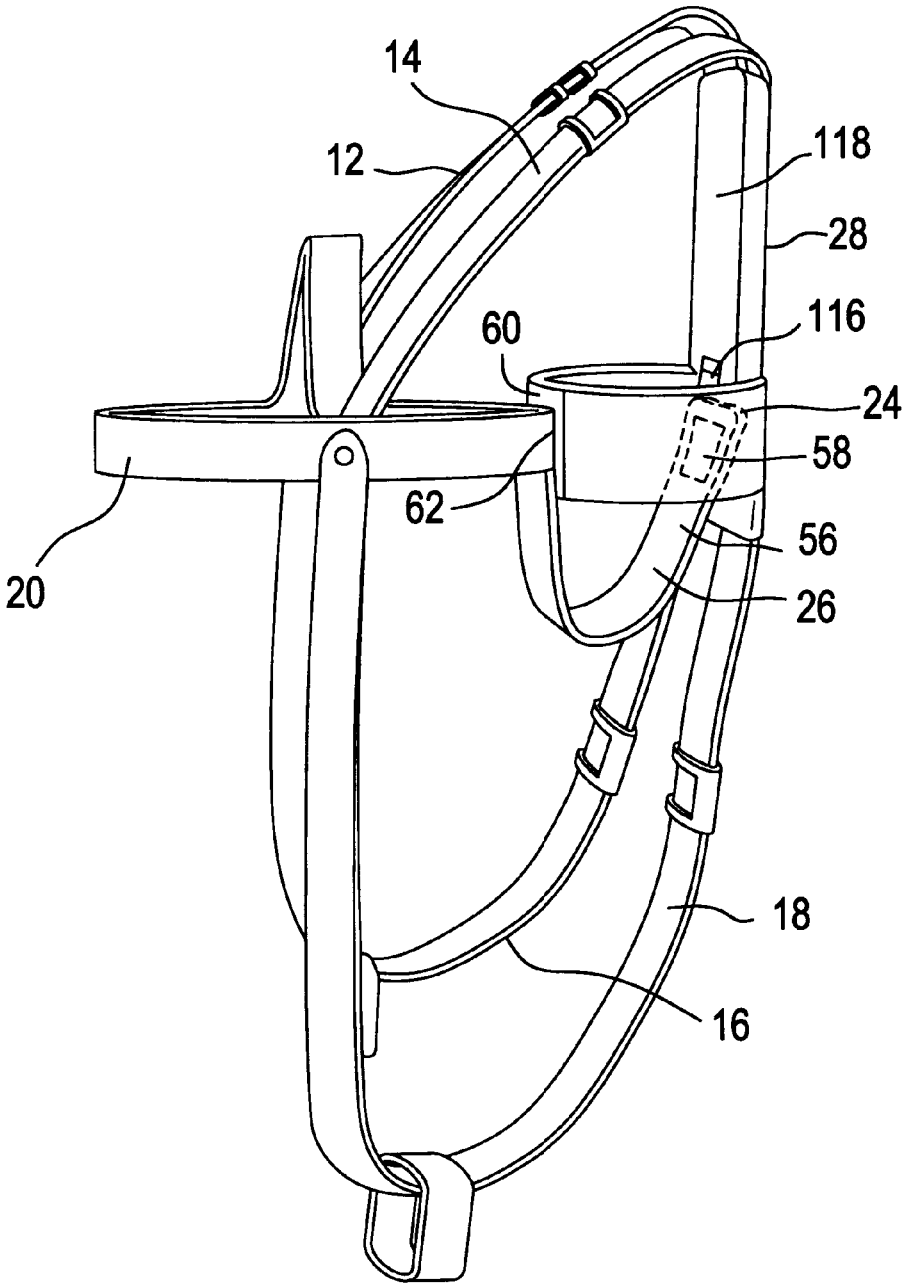
FIG. 3 is a side perspective view of the shoulder baby carrier of FIG. 1.

With reference to the drawings, wherein like reference numbers designate like or corresponding parts throughout, there is shown in FIGS. 1–4 a shoulder baby carrier 10 made in accordance with the present invention.

The shoulder baby carrier 10 includes a pair of baby shoulder straps 12, 14, a pair of underarm straps 16, 18, a horizontal head strap 20, an overhead strap 22, a baby waist strap 24, a baby seat strap 26, a baby back support 28, a pair of leg support straps 30, 32 and a pair of pivot pins 34, 36.

Figure 4:
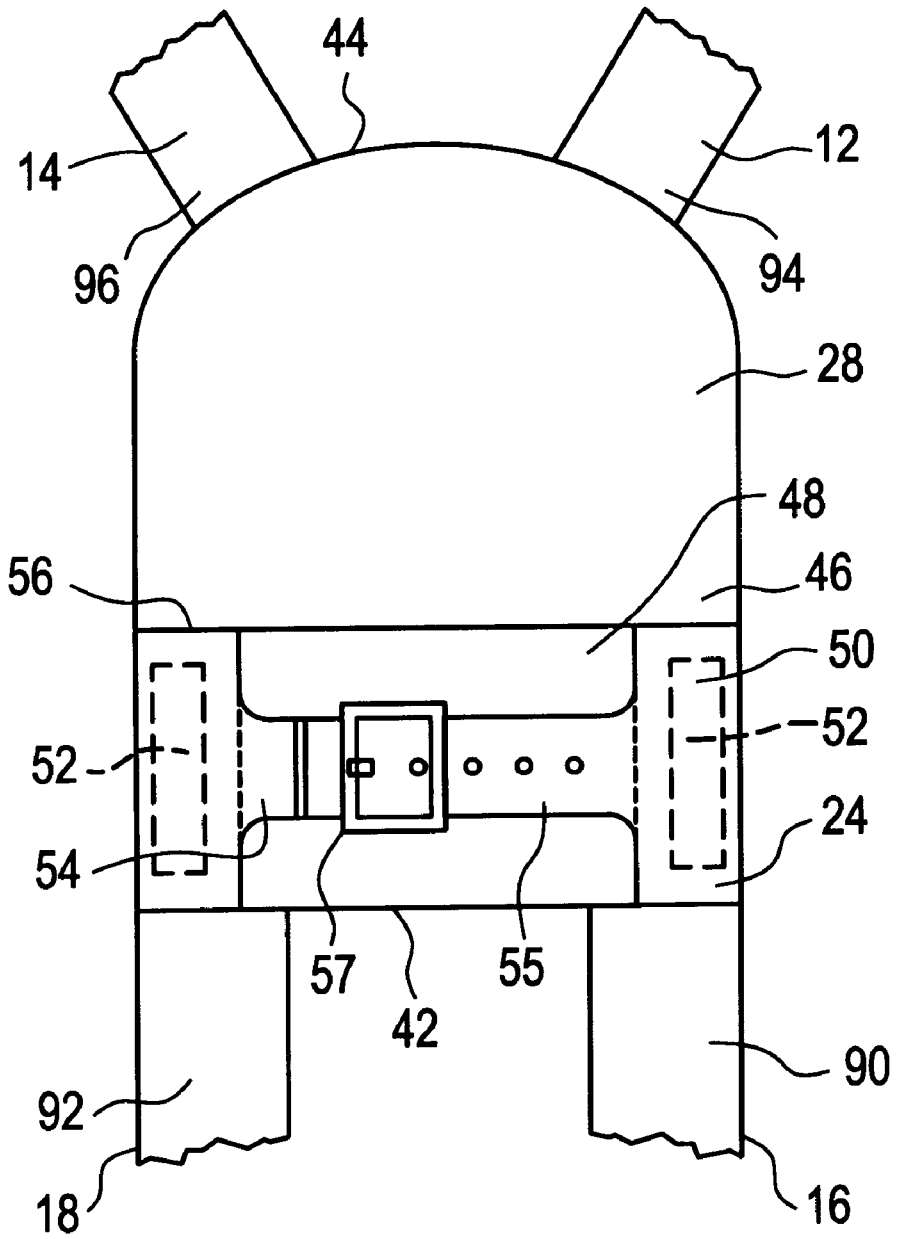
FIG. 4 is a fragmentary rear view of the shoulder baby carrier of FIG. 1.

The baby back support 28 is a generally rectangular member with generally straight and parallel side edges 38, 40, a straight bottom edge 42 and a curved top edge 44. As is shown in FIG. 4, the lower portion 46 of the baby back support 28 includes the loop portion 48 of a VELCRO® type hook and loop fastener 50. The baby waist strap 24 includes a hook portion 52 of the hook and loop fastener 52 which connects the rear portion 56 of the baby waist strap 24 to the baby back support 28. Ends 54, 55 of the baby waist strap 24 are connected by a conventional belt buckle 57, as is shown in FIG. 4.

Baby seat strap 26 has a rear end 56 which is connected to the baby back support 28 by a VELCRO® type hook and loop fastener 58. The front end 60 of the baby seat strap 26 is connected to the rear portion 62 of the horizontal head strap 20.

Front ends 64, 66 of the horizontal head strap 20 are adjustably connected to each other by a VELCRO® type hook and loop fastener 68.

Pivot pins 34, 36 are located on intermediate portions 72, 74 of the horizontal head strap 20. Pivot pin 34 connects the end 76 of the underarm strap 16, the end 70 of the baby shoulder strap 12 and the end 78 of overhead strap 22 with the intermediate portion 72 of horizontal head strap 20. Pivot pin 36 connects the end 82 of the underarm strap 18, the end 84 of the baby shoulder strap 14 and the end 86 of the overhead strap 22 with the intermediate portion 74 of the horizontal head strap 20.

Ends 90, 92 of the underarm straps 16,18 are connected to the bottom edge 42 of the baby back support 28. Ends 94, 96 of the baby shoulder straps 12,14 are connected to the top edge 44 of the baby back support 28. Leg support straps 30, 32 are connected to intermediate portions 102,104 of the underarm straps 16, 18. Baby shoulder straps 12,14 and the underarm straps 16,18 have adjustment buckles 106,108, 110,112, respectively.

During use, the user places the horizontal head strap 20 and the overhead strap 22 on his or her head and adjusts the ends 64, 66 to fit securely. As is shown in FIG. 1, the horizontal head strap 20 is positioned across the center of the forehead and the overhead strap 22 is tightened just enough to prevent the horizontal head strap 20 from slipping downward using hook and loop fastener 114. The shoulder baby carrier 10 is lifted off the user's head with the horizontal head strap 20 and the overhead strap 22 in place.

The baby waist strap 24 is placed around the baby's waist and the waist strap 24 is adjusted to fit the baby securely using the belt buckle 57 and the hook and loop fastener 52 on the baby back support 28.

The baby's legs are placed on each side of the baby seat strap 26 and adjusted by pressing the hook and loop fastener 58 on the end 56 of the baby seat strap 26 against a complementary hook and loop fastener 116 on the inside surface 118 of the baby back support 28.

The baby shoulder straps 12, 14 are adjusted so that the horizontal head strap 20 is parallel to the baby waist strap 24.

As is shown in FIG. 1, the baby is placed on the user's shoulders and the horizontal head strap 20 and overhead strap 22 are slipped over the user's head. The user slips his or her arms through the underarm straps 16, 18 and the underarm straps 16, 18 are adjusted to fit securely. The leg support strap 30, 32 are wrapped around the baby's ankles and adjusted to fit securely. The baby back support 28 provides support for the baby's head and thus provides a safe and comfortable seat for the baby.

In an alternative embodiment of the present invention the pivot pins 34, 36 are removable, thereby facilitating disassembly and re-assembly of the carrier 10 for purposes of cleaning the various components.

The foregoing specific embodiments of the present invention as set forth in the specification herein are for illustrative purposes only. Various deviations and modifications can be made within the spirit and scope of this invention, without departing from the main theme thereof.

I claim:

1. A shoulder baby carrier comprising:

a horizontal head strap, with said horizontal head strap forming a horizontally disposed loop, with said head strap having a first intermediate portion and a second intermediate portion, with said first and said second intermediate portions generally diametrically opposed;

an overhead strap with said overhead strap having a first end and a second end with said first end of said overhead strap attached to said first intermediate portion and with said second end of said overhead strap attached to said second intermediate portion;

a first underarm strap having a first end and a second end;

a second underarm strap having a first end and a second end, with said first end of said first underarm strap attached to said first intermediate portion of said horizontal head strap, with said first end of said second underarm strap attached to said second intermediate portion of said horizontal head strap;

a baby back support, with said second end of said first underarm strap and said second end of said second underarm strap each attached to said baby back support;

a baby seat strap, with said baby seat strap having a first end connected to said baby back support and a second end connected to said horizontal head strap;

a baby waist strap with said baby waist strap forming a loop and with said baby waist strap connected to said baby seat back; and a pair of baby shoulder straps with each of said baby shoulder straps having a first end and a second end, with said first end of said first baby shoulder strap attached to said baby back support, with said first end of said second baby shoulder strap attached to said baby back support, with said second end of said first baby shoulder strap and said second end of said second baby shoulder strap each attached to said horizontal head strap.

2. The shoulder baby carrier as claimed in claim 1, wherein said second end of said first baby shoulder strap is attached to said first intermediate portion of said horizontal head strap and in which said second end of said second baby shoulder strap is attached to said second intermediate portion of said horizontal head strap.

3. The shoulder baby carrier as claimed in claim 1, wherein said baby back support comprises:

a panel having an upper edge, a lower edge and a pair of side edges.

4. The shoulder baby carrier as claimed in claim 3, wherein said upper edge of said baby back support is curved.

5. The shoulder baby carrier as claimed in claim 3, wherein said second end of said first underarm strap and said second end of said second underarm strap are each attached to said lower edge of said baby back support.

6. The shoulder baby carrier as claimed in claim 1, wherein said first and said second underarm straps each further comprise:

a length adjustment buckle.

7. The shoulder baby carrier as claimed in claim 1, wherein said first and said second baby shoulder straps each further comprise:

a length adjustment buckle.

8. The shoulder baby carrier as claimed in claim 1, wherein said horizontal head strap, said overhead strap, said baby seat strap, and said baby waist strap each further comprise:

a hook and loop fastener length adjustment portion.

9. The shoulder baby carrier as claimed in claim 1, further comprising:

a first connecting pin, with said first connecting pin connecting said first end of said overhead strap, said first end of said first underarm strap, said second end of said first baby shoulder strap and said first intermediate portion of said horizontal head strap; and a second connecting pin connecting said second end of said overhead strap, said first end of said second underarm strap, said second end of said second baby shoulder strap and said second intermediate portion of said horizontal head strap.

10. The shoulder baby carrier as claimed in claim 9, wherein said first connecting pin and said second connecting pin each further comprises:

a removable connecting pin.

* * * * *